United States Patent [19]

Jensen

[11] Patent Number: 4,540,036

[45] Date of Patent: Sep. 10, 1985

[54] CONVEYOR FOR THE STEPWISE ADVANCE OF A VERTICALLY PARTED BOXLESS MOULD THROUGH A POURING AND COOLING ZONE

[75] Inventor: Kaj J. Jensen, Lyngby, Denmark

[73] Assignee: Dansk Industri Syndikat A/S, Herlve, Denmark

[21] Appl. No.: 510,897

[22] Filed: Jul. 5, 1983

[30] Foreign Application Priority Data

Jul. 15, 1982 [DK] Denmark ..... 3180/82

[51] Int. Cl.[3] ..... B22C 9/20; B22D 5/04

[52] U.S. Cl. ..... 164/323; 164/324; 198/622

[58] Field of Search ..... 164/322–324, 164/27, 29; 198/621, 622, 750

[56] References Cited

U.S. PATENT DOCUMENTS 3,744,552 7/1973 Lundsgart ..... 164/187

*Primary Examiner*—Nicholas P. Godici
*Assistant Examiner*—Kenneth F. Berg
*Attorney, Agent, or Firm*—Larson and Taylor

[57] ABSTRACT

In a conveyor for the stepwise advance of a vertically parted boxless mould through a pouring and cooling zone of a guideway each side of this guideway is composed of mutually reciprocable rods or rails, at least some of which are operative to carry along the mould in its advance step and which during the advance movement as well as during the periods of standstill keep the mould permanently compressed in its transverse direction to the benefit of the accuracy of the castings produced. For the purpose of limiting the effect of possible expansion forces on the castings before full hardening thereof, at least some of the guideway rods may comprise aligned sections which in case of longitudinal expansion of the mould may be drawn apart against spring resistance.

9 Claims, 3 Drawing Figures

FIG. 1
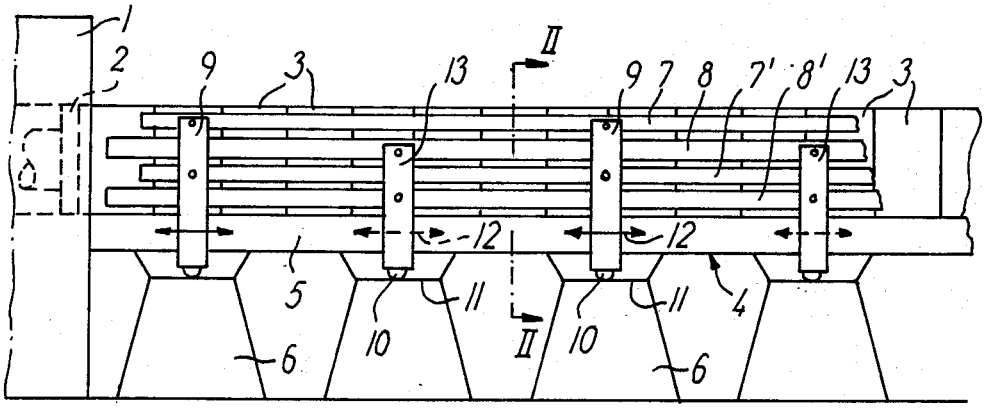
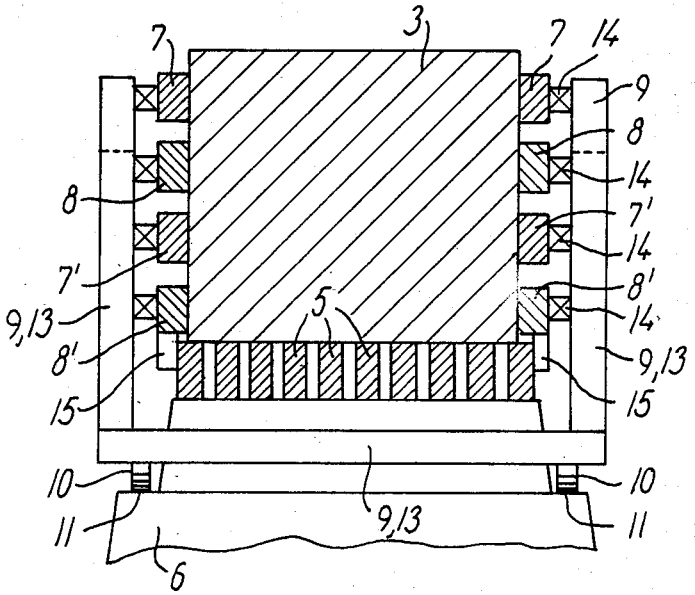
FIG. 2
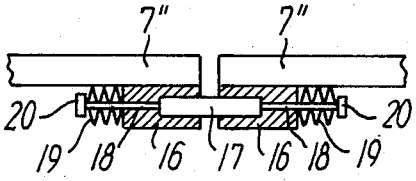
FIG. 3

CONVEYOR FOR THE STEPWISE ADVANCE OF A VERTICALLY PARTED BOXLESS MOULD THROUGH A POURING AND COOLING ZONE

FIELD AND BACKGROUND OF THE INVENTION

The invention relates to a conveyor for the stepwise advance of a vertically parted boxless mould through a pouring and cooling zone of a guideway having mould carrying bottom rails and longitudinally movable side rails arranged for the gripping and stepwise advance of the mould under permanent squeezing of said mould in its transverse direction.

The Danish patent specification No. 119 373, for instance (corresponding e.g. to U.S. Pat. specification No. 3,744,552) discloses a mould conveyor in which the two sides of the guideway are constituted of a pair of parallel rails connected with a common reciprocating mechanism, at least one of said rails being, concurrently with its longitudinal movement, transversely movable into and out of engagement with the mould. The advance of the mould can be derived solely from the two parallel rails, or these rails may supplement a conveying force exerted on the mould by one of the pressing plates used to successively compress the mould parts.

In this known conveyor, the two rails must during their conveying strokes exert strong opposite lateral pressures on the mould for its advance, while the mould must be entirely or substantially relieved from pressure during the reversing stroke of the rails. The mould is thereby subjected to alternating transverse and longitudinal loads which may cause minor deformations detrimental to the accuracy of the manufactured castings, and the fact that the conveyor cannot exert a permanent transverse squeezing of the mould, as stated above, can thus be regarded as a drawback of said conveyor.

Such a transverse squeezing or transverse compression is rendered possible by a conveyor as known from DE-C No. 27 27 867 for the same utilization, the guideway sides in this case being constituted of vertical plates or shields carried by circulating, stepwise running chains, the paths of movement of which are determined by stationary guiding rails. Compression springs holding the plates fixedly abutted against the sides of the mould are inserted between the chain links and the plates.

In order to allow the circulating movement, the length of the plates in the direction of movement cannot be substantially larger than the axial thickness of a single mould part, and for the same reason, the plates must necessarily, via their connection with the chains, be mutually pivotable about horizontal axes. Furthermore, the centre of the surface pressure between a pair of opposite plates and the mould part held therebetween is at substantial height above the stationary guideway bottom which exerts a very important friction against the conveying of the mould. All this results in the individual mould parts being subjected, during each advance stroke, to a couple (the conveying force from the plates and the braking frictional forces) and therefore having a tendency to tilt forwards. This may cause minor vertical displacements between the successive mould parts, thus in the joints where the pouring cavities are positioned, and there is therefore a risk of flaws as a result of a displacement between the portions of the same pouring cavity contained in their respective mould part.

SUMMARY OF THE INVENTION

This risk can be avoided by the conveyor according to the present invention, each guideway side in this case comprising at least two superposed lateral rods mutually reciprocable in the longitudinal direction of the guideway, each of these rods extending across a substantial number of joints of the mould.

The mutually reciprocable lateral rods can hold the mould permanently compressed in the transverse direction, at least on to the point where the cast metal is so hardened as to be no longer deformable, and even if the forces causing this compression may possibly vary slightly between the advance and standstill periods, it will be possible to keep these variations so small that they will be of no importance to the accuracy of the castings.

At the same time, the lateral rods which can extend across a very important part of the total length of the guideway establish a mutual interlocking between the transversely compressed mould parts, which counteracts their possible tendency to tilting. This tendency can, moreover, be reduced by lowering the level of the pressure centres of the lateral rods against the sides of the mould, which the present structure renders possible and, if desired, the said tendency can be entirely eliminated by designing the guideway bottom as a kind of travelling grate (which is known per se), whereby the advance of the mould can proceed without any frictional resistance when the movements of the reciprocating bottom and lateral rods are properly co-ordinated.

A preferred embodiment of the conveyor according to the invention is characterized in that at least one of the lateral rods disposed at each guideway side is both reciprocable in the longitudinal direction and transversely movable, whereas the other lateral rods are only movable in the transverse direction. In this case, the former and the latter lateral rods of the guideway must thus hold the mould transversely compressed to approximately the same extent during the advance and standstill periods, respectively, and their movement in the transverse direction must be controlled so that one set of lateral rods is not eased off the mould until said mould has been squeezed between the other lateral rods.

In the present invention, however, one can achieve a fixed, constant compression of the lateral rods against the mould. This can be achieved by allowing all the lateral rods of the guideway to be reciprocating in the longitudinal direction. In this case, the rods can be arranged in two groups which are movable in opposition to each other (like a usual travelling grate) and which alternately hold the mould transversely compressed during a complete cycle, viz. during a complete standstill period and the subsequent advance period, but all the lateral rods can also, according to the invention, be movable together during their forward stroke, while they are movable individually or in groups during the return stroke. Each of these two embodiments allows a transverse compression of the mould without noticeable variations, since a single or a few rods on each side can perform the return stroke under continuous pressure against the mould, while the mould is held stationary by the other, temporarily stationary rods.

A suitable equilibrium between the compression forces directed towards each other is desirable, and it can be achieved by disposing the lateral rods in pairs facing one another along the two guideway sides and by loading the lateral rods disposed in pairs at the same level preferably equally against the lateral surfaces of the mould.

The charge exerted by the lateral rods against the lateral surfaces of the mould can be variable, firstly in order to adjust it to different articles to be moulded so that the necessary conveying force is always available without a risk of overloading the mould and, secondly, along the length of the pouring and cooling zone in order to exert for instance the highest compression in the section where the moulded article is so hardened as to stand a high lateral pressure.

In order to counteract a lateral displacement of the mould in case of unsymmetrical load from the lateral rods, at least one of said rods at each guideway side can be associated with an arrest to limit the possible inward transverse movement of the rod.

According to the shape of the castings and the pouring quantity, the pouring can cause a not quite insignificant expansion of the mould, and since the lateral rods prevent a transverse enlargement of the mould, said expansion will in particular take place in the longitudinal direction. In order to allow such a longitudinal expansion, at any rate some of the lateral rods can be composed of relatively short sections having their adjacent ends spring-loaded by pre-tightened springs. When the mould is temporaily held totally or substantially stationary by these lateral rods, it will be possible for expansion forces, if any, in the mould to overcome the pre-tightening of the spring between a pair of rod sections so that these are drawn apart, whereby the castings are to a substantial extent relieved from the expansion forces. When the rods in question are, in the subsequent phase, eased off the mould, the sections are again drawn towards each other by the springs.

A similar arrangement can for the same purpose be used in the mould-carrying bottom rails.

BRIEF DESCRIPTION OF THE DRAWINGS

FIG. 1 shows a lateral view of a section of a casting plant with a conveyor according to the invention, FIG. 2 a cross section on an enlarged scale along line II—II in FIG. 1, and FIG. 3 part of a guideway rod with a spring-loaded expansion connection between two rod sections.

DETAILED DESCRIPTION OF THE PREFERRED EMBODIMENTS

In FIG. 1, 1 indicates a device known per se for the manufacture of boxless mould parts by compression of sand or similar material in a press chamber between a pair of opposite press plates carrying half patterns corresponding to the cast articles to be manufactured. After manufacturing of a mould part, one press plate not shown in the drawing is swung away and the other press plate 2 is used to convey the newly produced mould part out of the press chamber and add it to a row of previously manufactured mould parts 3 which are disposed in a pouring and cooling guideway 4 in which the row of mould parts is advanced stepwise in time with the manufacture of the mould parts. Part of the force necessary to this stepwise advance can be exerted by the plunger 2, while an additional force is produced in another way as explained hereinafter.

The pouring and cooling guideway 4 has a bottom consisting of a number of longitudinally disposed bottom rails 5 which in the embodiment shown are carried steadily and immovably by a number of supports 6 while each of the guideway sides is constituted of mutually movable lateral rods 7, 7′ and 8, 8′ disposed in pairs opposite each other and which in the embodiment shown are all movable in the longitudinal direction of the guideway as well as in the transverse direction, i.e. towards and away from the row of mould parts 3.

In order to achieve longitudinal mobility, the rods 7 and 7′ on both sides are carried by U-shaped frames 9 which through wheels 10 rest on runways 11 on the supports 6 and which can be reciprocated as indicated by the double arrows 12 by means of a mechanism of conventional type not shown in detail, preferably hydraulically, while the lateral rods 8 and 8′ are carried by analogous U-frames 13.

The mobility in the transverse direction is ensured by inserting between each of the lateral rods 7, 7′, 8, 8′ and the vertical legs of the appurtenant U-frames 9 or 13 hydraulic or pneumatic pressure boxes 14 or similar mechanisms which, as required, can increase or decrease the distance between the lateral rods and the legs of the U-frames.

In the situation shown in the drawing, the lateral rods 7,7′ are assumed to be moving to the right, thus in their forward stroke, while they are by means of the pressure boxes 14 pressed against the sides of the row of mould parts 3. Thereby these lateral rods 7 and 7′ serve to provide the above-mentioned additional force to convey the complete mould. At the same time, the lateral rods 8 and 8′ are in their left terminal position and are eased so much off the sides of the mould that they do not prevent its advance. Each advance step has suitably a length corresponding to the axial thickness of a mould part 3, and at the end of the step in progress, the pressure boxes appurtenant to the lateral rods 8 and 8′ are actuated so that these lateral rods now hold the mould 3 under load in the transverse direction, whereafter the other lateral rods 7 and 7′ are eased off the mould and return to their left terminal position, and a new advance step can be initiated when a next mould part 3 is added to the mould.

Other possibilities of stepwise advance of a mould by means of lateral rods and under continuous squeezing of the mould in the lateral direction have been mentioned above and will not be repeated here.

The pressure of the lateral rods on the sides of the mould can be varied as required by suitable control of the pressure boxes 14 or the corresponding mechanisms. The capacity of the mould to stand this lateral pressure can thereby be taken into consideration. This capacity depends to some extent on the shape and size of the castings and varies, moreover, in the longitudinal direction of the pouring and cooling guideway 4, since it goes without saying that it increases substantially with the hardening of the cast metal.

Although an equilibrium is aimed at between the load on the two lateral surfaces of the mould, there can in practice be such differences that there is a risk of lateral displacement of the mould on the bottom rails 5. In order to counteract this displacement, the two lowest lateral rods 8′ in the embodiment shown are provided with arrests 15 which by abutment against the outer bottom rails 5 limit the possible, inward transverse movement of the lateral rods.

FIG. 3 shows a lateral rod which is composed of two sections 7″ with an expansion mechanism inserted therebetween for the above-explained purpose. To the rod section 7″ are fastened blocks or bushings 16 with bores for a common dowel 17 which ensures linearity of the rod sections 7″ and by terminal abutment against the bottom of the bores determines a certain minimum interval between these sections. In the ends of the dowel, thinner pins 18 are fastened, said pins being slidingly movable in corresponding bores in the blocks 16 being outside these blocks surrounded by compression springs 19 which are positioned with a certain pretightening between the terminal surfaces of the blocks and heads 20 on these pins and thereby aim at keeping the two rod sections 7″ in the basic position shown but can yield if the mould expands in the longitudinal direction while it is laterally loaded by the rod 7″, 7″.

Similar expansion mechanisms can, as required, be placed in the bottom rails 5 which then, over at least part of their length must be movably secured to the supports 6.

I claim:

1. A conveyor for the stepwise advance of a vertically parted boxless mould through a pouring and cooling zone, comprising a guideway having mould-carrying bottom rails and longitudinally movable side rails arranged on both sides of said guideway for advancing the mould stepwise while permanently squeezing the mould in its transverse direction, the side rails on each side of said guideway comprising at least two superposed lateral rods which are transversely movable inwardly for squeezing a mould in said guideway and moveable outwardly to ease said rod off a mould in said guideway, at least one of said rods on each side of said guideway being reciprocable in the longitudinal direction of the guideway, and each rod having a length sufficient to extend along a plurality of successive parts of the mould;

means for transversely moving each of said superposed rods inwardly and outwardly; and means for controlling said rod moving means such that at least one superposed lateral rod on both sides of the guideway is not eased off a mould in said guideway until at least one other superposed lateral rod on both sides of said guideway is moved inwardly for squeezing a mould in said guideway whereby a mould in said guideway is held transversely compressed to approximately the same extent during the advancement of a mould along said guideway.

2. A conveyor as claimed in claim 1, wherein at least one of said lateral rods on each side of said guideway is both reciprocable in the longitudinal direction and transversely movable, and at least one other lateral rod of the same guideway side is movable only in the transverse direction.

3. A conveyor as claimed in claim 1, wherein all of said lateral rods on each side of said guideway are longitudinally reciprocable and are movable together during their forward stroke, at least one rod on each side of said guideway being moveable relative to the other rods on each respective side of said guideway during the return stroke.

4. A conveyor as claimed in claim 1, wherein said lateral rods are arranged in pairs facing one another along the two guideway sides, said conveyor comprising means for substantially equally loading each pair of lateral rods disposed at the same level against the lateral surfaces of the mould.

5. A conveyor as claimed in claim 1, further comprising means for urging said lateral rods against the lateral surfaces of the mould under a loading that is adjustable to different articles to be moulded.

6. A conveyor as claimed in claim 1, further comprising means for urging said lateral rods against the lateral surfaces of the mould under a loading that is variable along the length of the pouring and cooling zone of the guideway.

7. A conveyor as claimed in claim 1, wherein at least one of said lateral rods at each side of the guideway is associated with an arrest to limit the possible inward transverse movement of the rod.

8. A conveyor as claimed in claim 1, whrein at least some of said lateral rods comprise aligned sections having their adjacent ends spring-loaded against each other.

9. A conveyor as claimed in claim 1, wherein said mould-carrying bottom rails comprise aligned sections having their adjacent ends spring-loaded against each other.

* * * * *